US009890997B2

(12) United States Patent
Montes

(10) Patent No.: US 9,890,997 B2
(45) Date of Patent: Feb. 13, 2018

(54) BOXING GLOVE DRYING AND DISINFECTING DEVICE AND METHOD THEREFOR

(71) Applicant: Bernardo Montes, Phoenix, AZ (US)

(72) Inventor: Bernardo Montes, Phoenix, AZ (US)

( * ) Notice: Subject to any disclaimer, the term of this patent is extended or adjusted under 35 U.S.C. 154(b) by 560 days.

(21) Appl. No.: 14/306,082

(22) Filed: Jun. 16, 2014

(65) Prior Publication Data

US 2014/0373380 A1 Dec. 25, 2014

Related U.S. Application Data

(60) Provisional application No. 61/839,078, filed on Jun. 25, 2013.

(51) Int. Cl.

| | |
|---|---|
| ***F26B 25/00*** | (2006.01) |
| ***F26B 21/00*** | (2006.01) |
| ***F26B 9/00*** | (2006.01) |

(52) U.S. Cl.

CPC ..... *F26B 21/004* (2013.01); *F26B 9/003* (2013.01)

(58) Field of Classification Search

CPC ..... F26B 23/00; F26B 21/004; F26B 9/008
USPC ..... 34/104, 107, 437, 443
See application file for complete search history.

(56) References Cited

U.S. PATENT DOCUMENTS

| | | | | |
|---|---|---|---|---|
| 686,884 | A | 11/1901 | Becker | |
| 1,475,193 | A | 11/1923 | Meehan | |
| 3,217,333 | A | 11/1965 | Sweet et al. | |
| 4,084,733 | A | 4/1978 | Perlmutter | |
| 4,209,913 | A | 7/1980 | Wallin et al. | |
| 4,689,897 | A | 9/1987 | Marsalona | |
| 4,991,756 | A | 2/1991 | Benjamin | |
| 5,125,169 | A | 6/1992 | Bader | |
| 6,076,713 | A | 6/2000 | Boudreau et al. | |
| 6,085,436 | A * | 7/2000 | Peet | D06F 59/04 223/78 |
| 7,716,849 | B1 | 5/2010 | Hicks | |
| 8,365,431 | B1 | 2/2013 | Parish | |
| 2005/0109415 | A1* | 5/2005 | Snyder | F24F 13/0209 138/162 |
| 2009/0100699 | A1 | 4/2009 | Hasler | |
| 2013/0212900 | A1* | 8/2013 | Stewart | D06F 59/04 34/275 |

* cited by examiner

*Primary Examiner* — John McCormack
(74) *Attorney, Agent, or Firm* — Weiss & Moy, P.C.; Jeffrey D. Moy

(57) ABSTRACT

A boxing glove drying device has a body member. The body member has an open end and a closed end. The closed end is curved and configured for inserting into a boxing glove. A plurality of openings is formed in the body member.

9 Claims, 7 Drawing Sheets

BOXING GLOVE DRYING AND DISINFECTING DEVICE AND METHOD THEREFOR

RELATED APPLICATIONS

This application claims the benefit of U.S. Provisional Application No. 61/839,078, filed Jun. 25, 2013, in the name of the same inventor and which is incorporated herein by reference in its entirety.

TECHNICAL FIELD

The present invention relates to sporting equipment, and more particularly to a device which stretches out and opens up a boxing glove to allow one to remove moisture and dry out the boxing glove.

BACKGROUND

Athletic or sports gear (hereinafter sports gear) that is in constant contact with an athlete's body (like sport specific gloves and footwear) become most with perspiration from the athlete. In some sports, such as boxing, other matter such as blood or other bodily fluid may also contribute to the moisture build-up. If the moisture is not properly removed, the accumulated moisture can damage and or ruin the sports gear. Furthermore, the moisture may become a breeding ground for germs, which results in a foul scent and potential infectious disease such as staff infections.

In general, it is fairly easy to remove moisture from the exterior surface of most sports gear. A towel or other item may be used to gentle wipe the exterior surface of the sports gear to remove the moisture. However, removing the moisture from the interior of the sports gear is generally more difficult. This is due to the narrow interior spaces formed in most sports gear. For some items such as shoes, the interior may be dried by removing the laces and opening up the shoe to allow air to circulate within the shoe and dry the interior. However, for items such as boxing gloves, there is generally no way to remove moisture from the interior. Boxing gloves generally have a closed interior which prevents air from circulating therein. While air may reach the opened end of the boxing glove, the curved top section of the boxing glove prevents air from every reaching the distal end of the boxing glove.

Therefore, it would be desirable to provide a device and method that overcomes the above.

SUMMARY

This summary is provided to introduce a selection of concepts in a simplified form that are further described below in the DESCRIPTION OF THE APPLICATION. This summary is not intended to identify key features of the claimed subject matter, nor is it intended to be used as an aid in determining the scope of the claimed subject matter.

A boxing glove drying device has a body member. The body member has an open end and a closed end. The closed end is curved and configured for inserting into a boxing glove. A plurality of openings is formed in the body member.

A boxing glove drying device has a body member configured for inserting into a boxing glove and to open up the boxing glove. A plurality of openings is formed in the body member.

A boxing glove drying device has a body member configured for inserting into a boxing glove. A plurality of openings is formed in the body member.

The features, functions, and advantages may be achieved independently in various embodiments of the disclosure or may be combined in yet other embodiments.

BRIEF DESCRIPTION OF DRAWINGS

The novel features believed to be characteristic of the application are set forth in the appended claims. In the descriptions that follow, like parts are marked throughout the specification and drawings with the same numerals, respectively. The drawing figures are not necessarily drawn to scale and certain figures can be shown in exaggerated or generalized form in the interest of clarity and conciseness. The application itself, however, as well as a preferred mode of use, further objectives and advantages thereof, will be best understood by reference to the following detailed description of illustrative embodiments when read in conjunction with the accompanying drawings, wherein:

DESCRIPTION OF THE APPLICATION

The description set forth below in connection with the appended drawings is intended as a description of presently preferred embodiments of the application and is not intended to represent the only forms in which the present application can be constructed and/or utilized. The description sets forth the functions and the sequence of steps for constructing and operating the application in connection with the illustrated embodiments. It is to be understood, however, that the same or equivalent functions and sequences can be accomplished by different embodiments that are also intended to be encompassed within the spirit and scope of this application.

Figure 1:
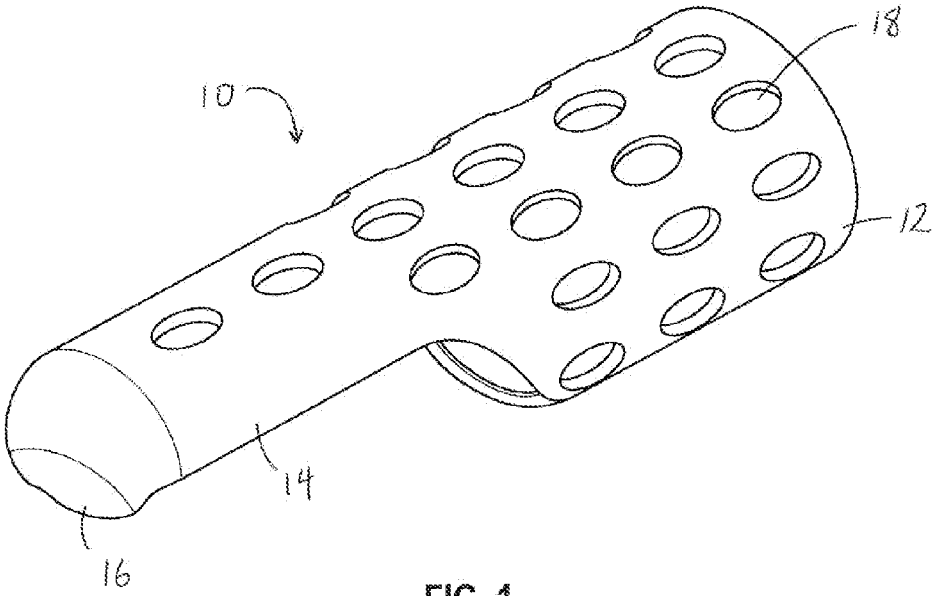
FIG. 1 is a perspective view of one embodiment of a device to allow one to remove moisture and dry out a boxing glove.
Figure 2:
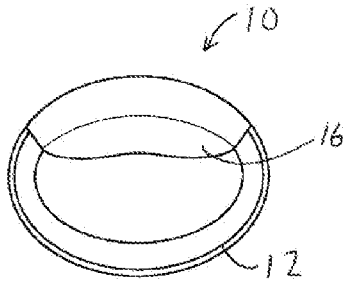
FIG. 2 is a top view of the device of FIG. 1.
Figure 3:
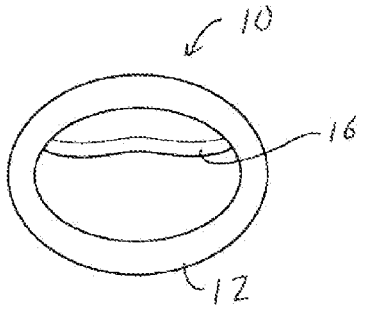
FIG. 3 is a bottom view of the device of FIG. 1.
Figure 4:
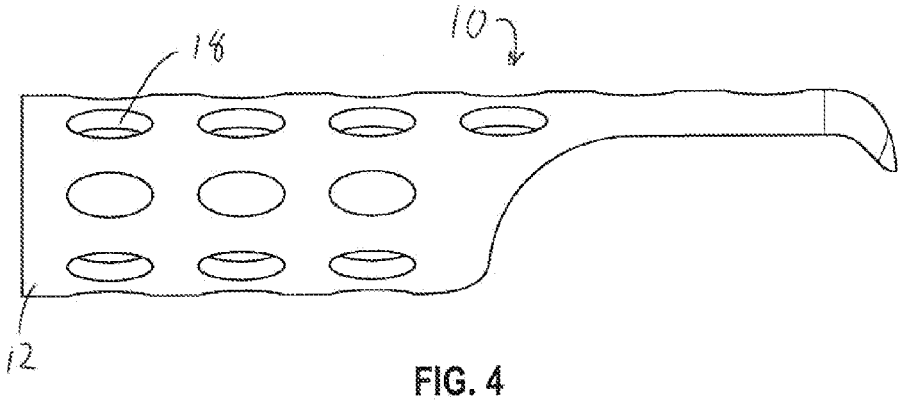
FIG. 4 is a first side view of the device of FIG. 1.
Figure 5:
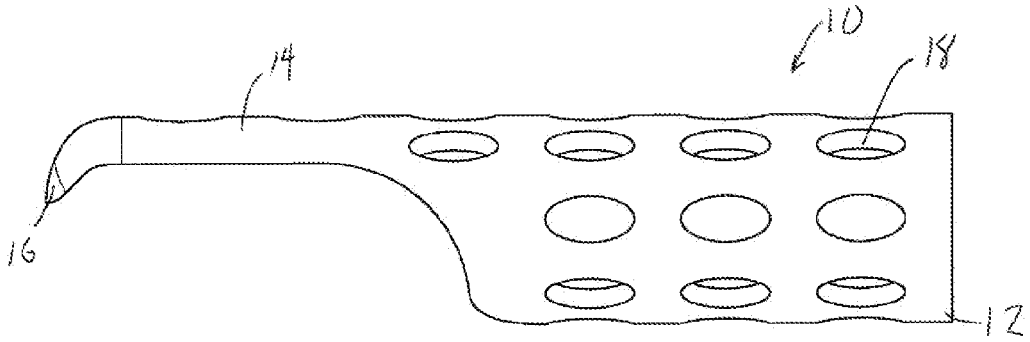
FIG. 5 is a second side view of the device of FIG. 1.
Figure 6:
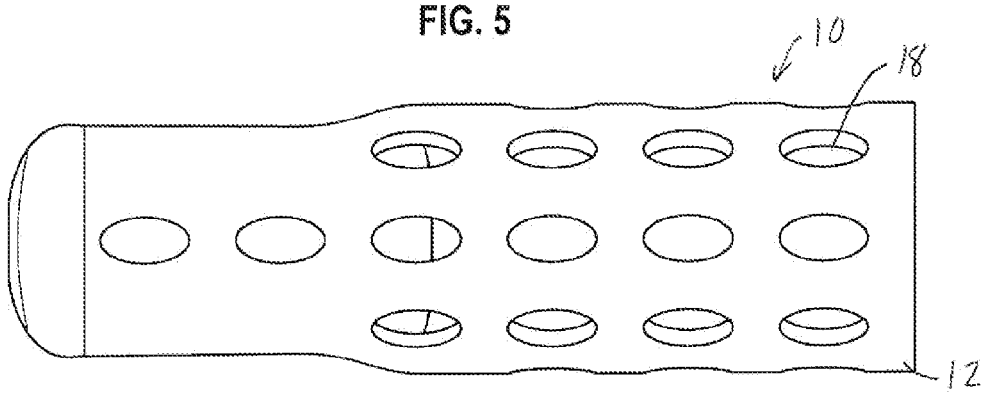
FIG. 6 is a rear view of the device of FIG. 1.
Figure 7:
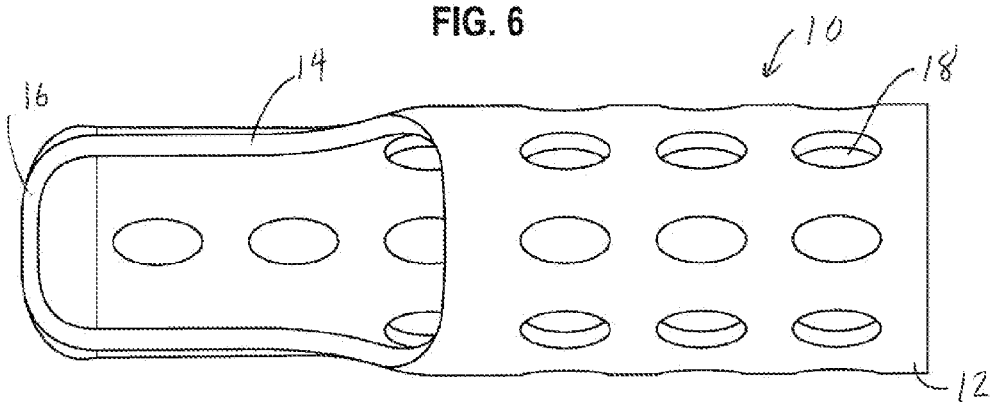
FIG. 7 is a front view of the device of FIG. 1.
Figure 8:
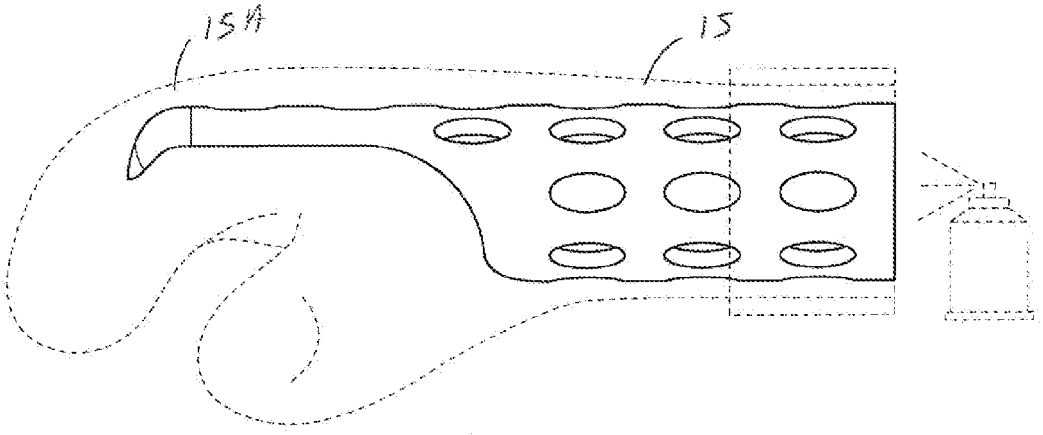
FIG. 8 is a side view of the device of FIG. 1 placed in a boxing glove.

Referring to FIGS. 1-8, one embodiment of a boxing glove drying device 10 (hereinafter device 10) is shown. The device 10 may be inserted into a boxing glove 15 to stretch out and opens up the boxing glove 15 to allow one to remove moisture and dry out the boxing glove 15. The device 10 may be comprised of a body member 12. The body member 12 may be a tubular body member 12. The tubular body member 12 may be oval in shape. However, the above is given as one example and should not be seen in a limiting manner.

The body member 12 may be formed out of different types of material. In general, a sturdy but lightweight material such as a hardened plastic, carbon-fiber, aluminum or the like may be used. However, the above mentioned materials are given as an example and should not be seen in a limiting manner.

The body member 12 is configured so that a member 14 may extend from a top surface of the body member 12. The member 14 may be curved to conform to a shape of the body member 12. The member 14 may be used to extend into a top section 15A of the boxing glove 15 where the fingers of a boxer may be positioned when in use. When the device 10 is inserted into the boxing glove 15, the member 14 may extend into the finger area of the interior of the boxing glove stretching open the interior of the boxing glove 15.

A rounded lip member 16 may extend from a distal end of the member 14. In the embodiment shown in the FIGS. 1-7, the rounded lip member 16 may extend downward. The rounded lip 16 may be used to conform to an interior of the boxing glove 15. The rounded lip member 16 may prevent damage to the interior of the boxing glove 15.

The body member 12 and the member 14 may have a plurality of openings 18 formed there through. In the body member 12, the openings 18 may be formed around the entire perimeter of the body member 12. The openings 18 may be used to allow air to circulate within the boxing glove in order to remove moisture within the boxing glove when the device 10 may be inserted into the boxing glove 15.

In operation, the device 10 may be inserted into an interior of a boxing glove 15. Once inserted, the rounded lip member 16 may push against a top interior section of the boxing glove 15. This may extend the finger section of the boxing glove 15 slightly upward to open up the interior section of the boxing glove 15. Once the finger section of the boxing glove 15 is extended upward to open up the interior of the boxing glove 15, a disinfectant and or water removal aerosol may be sprayed into the device 10. The openings 18 formed in the device 10 may allow the disinfectant and or water removal aerosol to disperse throughout the interior of the boxing glove 15 as well as to allow air to circulate within the boxing glove 15 in order to remove moisture within the boxing glove 15. Once the disinfectant and or water removal aerosol is dispersed throughout the interior of the boxing glove, the boxing glove 15 is allowed to sit. The device 10 allows air to circulate within the boxing glove 15 in order to remove any moisture within the boxing glove 15.

Figure 9:
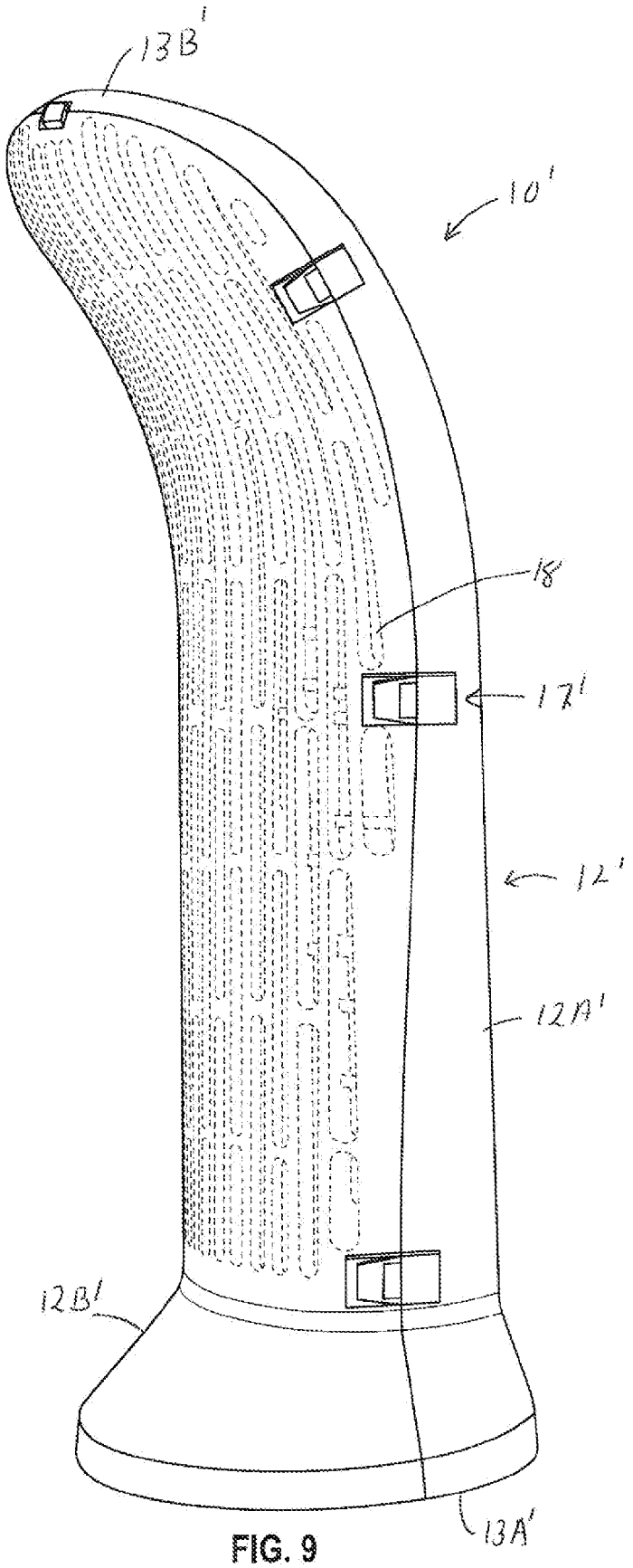
FIG. 9 is a perspective view of another embodiment of a device to allow one to remove moisture and dry out a boxing glove.
Figure 10:
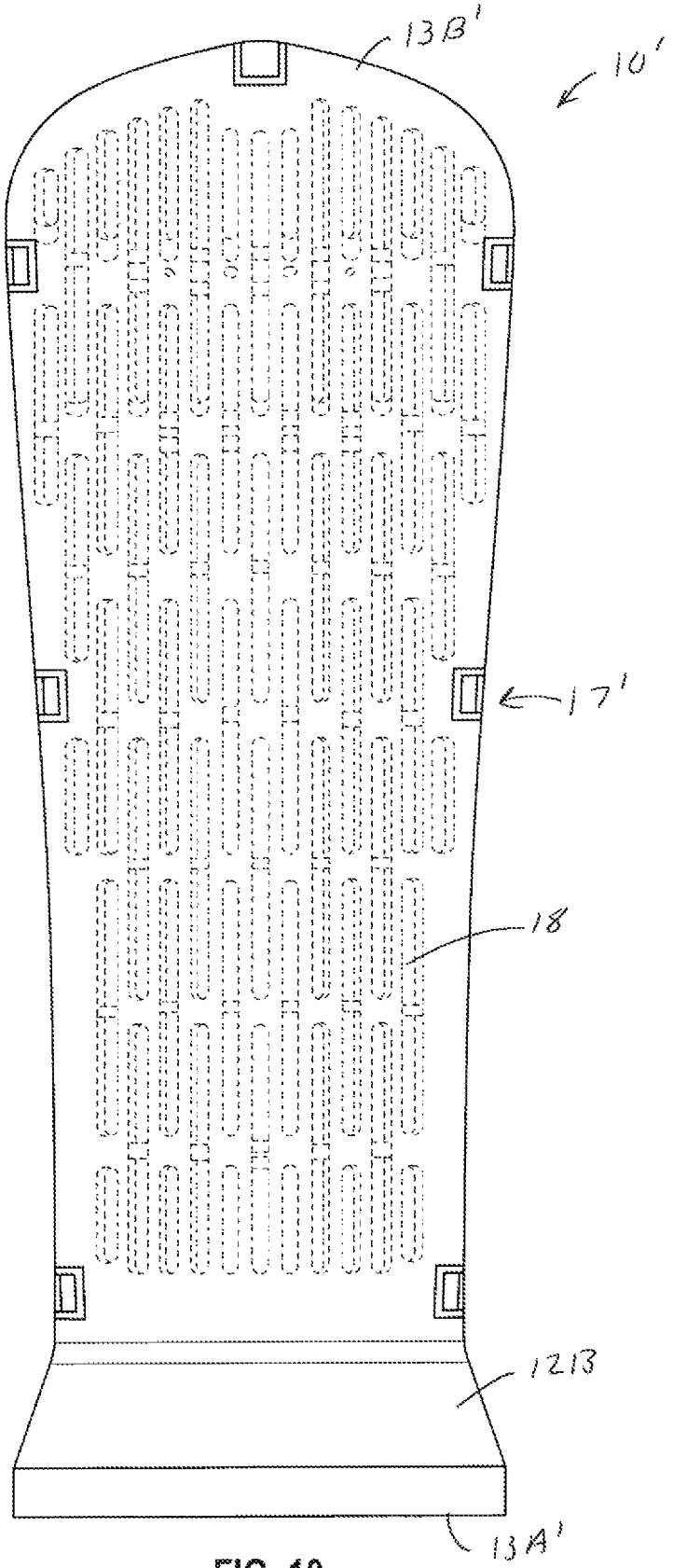
FIG. 10 is a front view of the device of FIG. 9
Figure 11:
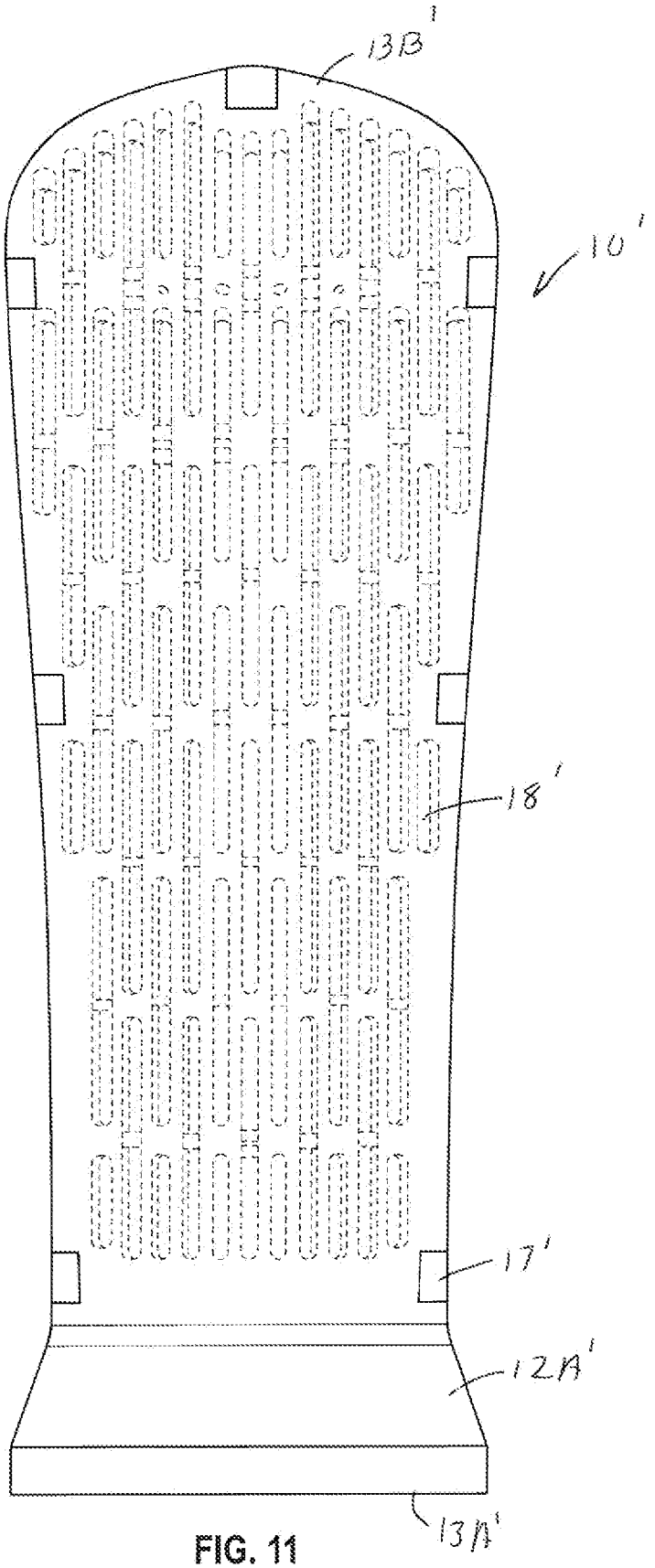
FIG. 11 is a rear view of the device of FIG. 9.
Figure 12:
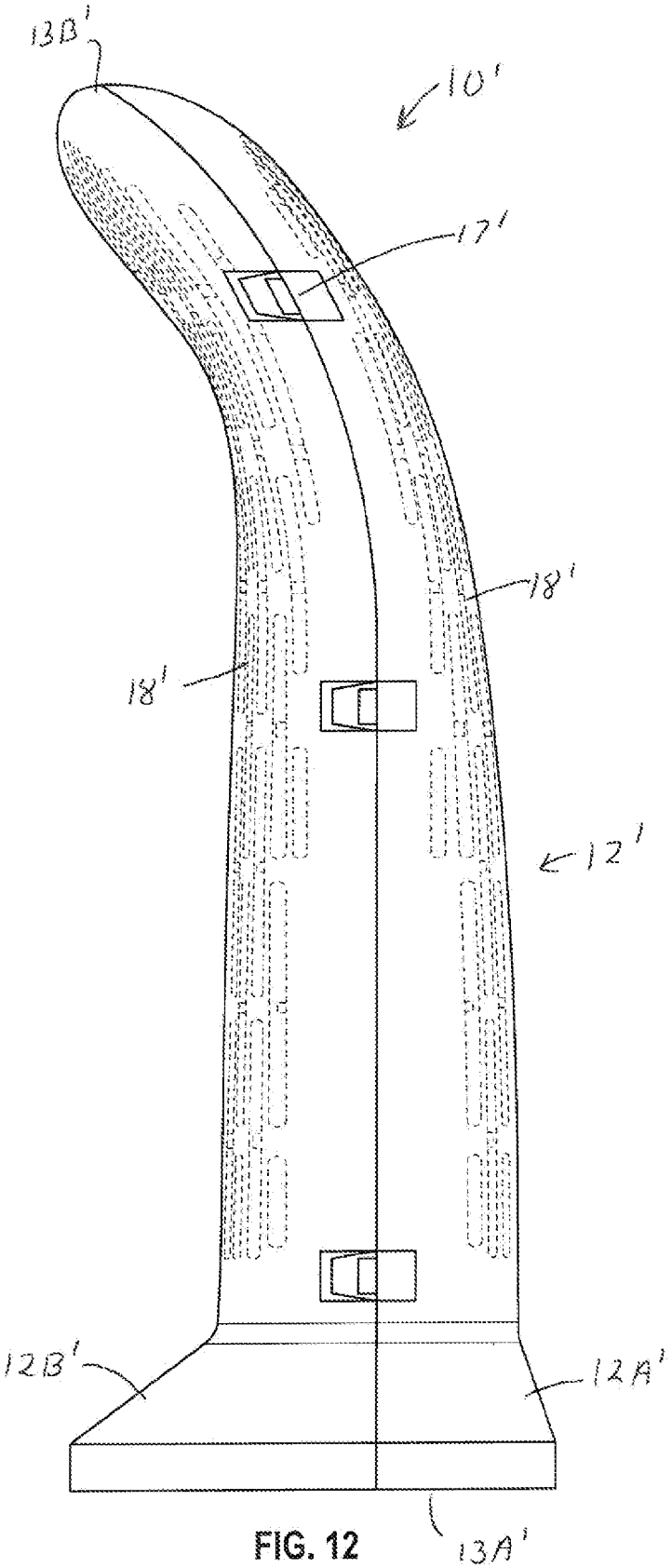
FIG. 12 is a side view of the device of FIG. 9.
Figure 13:
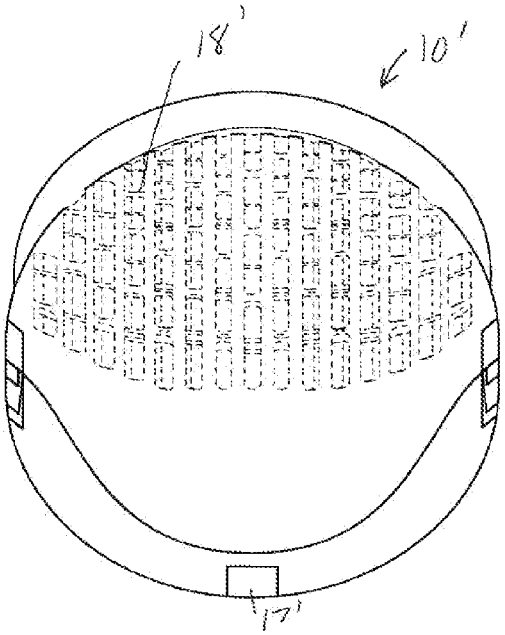
FIG. 13 is a top view of the device of FIG. 9.
Figure 14:
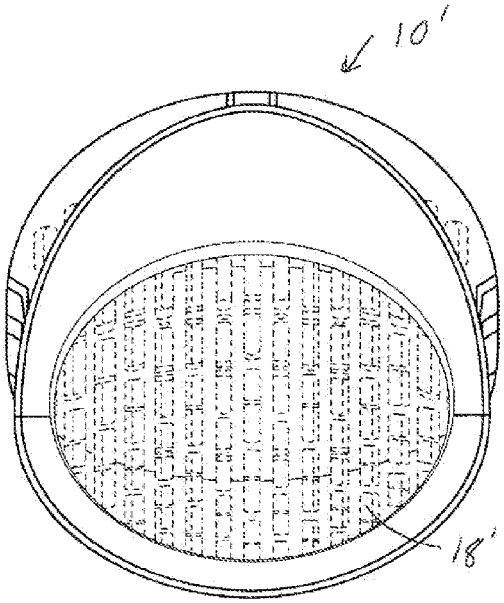
FIG. 14 is a bottom view of the device of FIG. 9.
Figure 15:
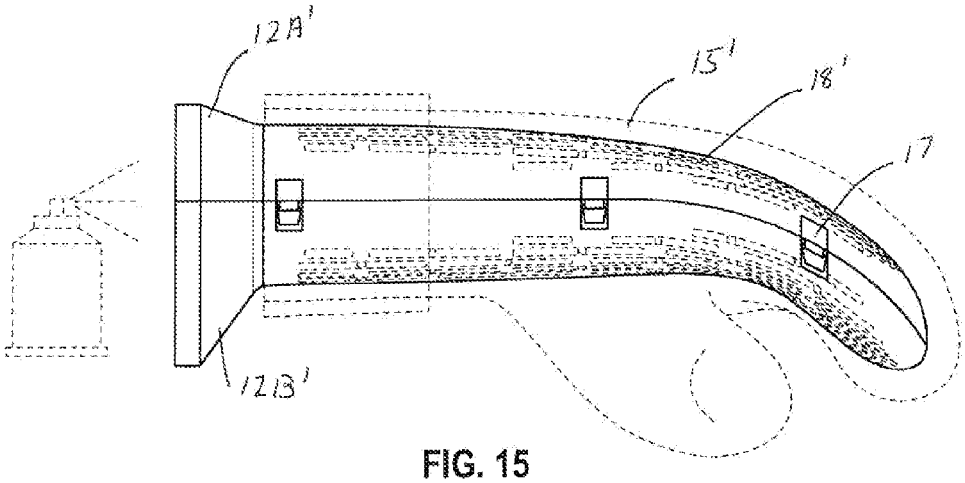
FIG. 15 is a side view of the device of FIG. 9 placed in a boxing glove.

Referring to FIGS. 9-15, another embodiment of a boxing glove drying device 10' (hereinafter device 10') is shown. The device 10' may be inserted into a boxing glove to stretch out and opens up the boxing glove to allow one to remove moisture and dry out the boxing glove. The device 10' may be comprised of a body member 12'. The body member 12' is generally a tubular body member 12'. The tubular body member 12' may be oblong in shape. However, the above is given as one example and should not be seen in a limiting manner.

The body member 12' may have an open end 13A' and a closed end 13B'. The body member 12' may be slightly tapered as body member 12' progresses towards the closed end 13B'. The body member 12' may also be slightly curved towards the closed end 13B'. The body member 12' may be curved to angle away from a centerline running from a centerpoint of the open end 13A'. The body member 12' may be slightly curved to conform to a shape of a boxing glove. The slightly curved closed end 13B' of the body member 12' may be used to extend into a top section of the boxing glove where the fingers of a boxer may be positioned when in use. When the device 10' is inserted into the boxing glove 15', the slightly curved closed end 13B' of the body member 12' may extend into the finger area of the interior of the boxing glove 15' stretching open the interior of the boxing glove 15'.

The body member 12' may be formed a single member or alternatively, the body member 12' may be formed of a pair of detachable pieces 12A' and 12B'. Each of the pair of pieces 12A' and 12B' may have a connector 17' formed therein. The connectors 17' may be used to secure the pair of pieces 12A' and 12B' together to form the body member 12'. The connectors 17' may be clips, male/female connectors, or the like. The above listing is given as an example and should not be seen in a limiting manner.

The body member 12' may be formed out of different types of material. In general, a sturdy but lightweight material such as a hardened plastic, carbon-fiber, aluminum or the like may be used. However, the above mentioned materials are given as an example and should not be seen in a limiting manner.

The body member 12' may have a plurality of openings 18' formed there through. In the body member 12', the openings 18' may be formed around the entire perimeter of the body member 12'. The openings 18' may be used to allow air to circulate within the boxing glove in order to remove moisture within the boxing glove.

In operation, the device 10' may be inserted into an interior of a boxing glove 15'. Once inserted, the curved closed end 13B' pushes against a top interior section of the boxing glove 15'. This extends the finger section of the boxing glove 15' slightly upward to open up the interior section of the boxing glove 15'. Once the finger section of the boxing glove 15' is extended upward to open up the interior of the boxing glove 15', a disinfectant and or water removal aerosol may be sprayed into the device 10' through the open end 13A'. The openings 18' formed in the device 10' may allow the disinfectant and or water removal aerosol to disperse throughout the interior of the boxing glove as well as to allow air to circulate within the boxing glove in order to remove moisture within the boxing glove. Once the disinfectant and or water removal aerosol is dispersed throughout the interior of the boxing glove 15', the boxing glove 15' is allowed to sit. The device 10' allows air to circulate within the boxing glove 15' in order to remove any moisture within the boxing glove 15'.

While embodiments of the disclosure have been described in terms of various specific embodiments, those skilled in the art will recognize that the embodiments of the disclosure may be practiced with modifications within the spirit and scope of the claims.

What is claimed is:

1. A boxing glove drying device comprising:

a body member, wherein the body member is an oblong tubular member having an open end and a closed end, the dosed end being curved to angle away from a centerline running from a center of the open end and configured for inserting into a boxing glove, the body member progressively tapers from the open end towards the closed end, the body member being, formed of a pair of detachable members formed lengthwise along the body member;

a plurality of openings formed in the body member.

2. The boxing glove drying device in accordance with claim 1, wherein the body member progressively tapers to get narrower from the open end towards the closed end.

3. The, boxing glove drying device in accordance with claim 1, further comprising a plurality of connectors formed on the pair of detachable members for securing the pair of detachable pieces together.

4. The boxing glove drying device in accordance with claim 1 wherein the plurality of openings are formed along a majority of a length of the body member.

5. A boxing glove drying device comprising:

a body member configured for inserting into a boxing glove and to open up the boxing glove, wherein the body member comprises an oblong tubular member having an open end and a closed end, the closed end being curved and configured for inserting into a boxing glove, the body member progressively tapers from the open end towards the closed end, the body member being formed of a pair of detachable members formed lengthwise along the body member;

a plurality of connectors for securing the pair of detachable members together; and a plurality of openings formed in the body member.

6. The boxing glove drying device in accordance with claim 5 wherein the plurality of openings are formed along a majority of a length of the body member.

7. A boxing glove drying device comprising:

a body member configured for inserting into a boxing glove wherein the body member comprises a pair of detachable members formed lengthwise along the body member, the body member having an open end and a closed end, the closed end being curved to angle away from a centerline running from a center of the open end and configured for inserting into a boxing glove, the body member progressively tapers from the open end towards the closed end;

a plurality of connectors formed on the pair of detachable members for securing the pair of detachable members together; and a plurality of openings formed in the body member.

8. The boxing glove drying device in accordance with claim 7, wherein the body member gets narrower as the body member progressively tapers from the open end towards the closed end.

9. The boxing glove drying device in accordance with claim 7 wherein the plurality of openings are formed along a majority of a length of the body member.

* * * * *